US005335450A

United States Patent [19]

Procton

[11] Patent Number: 5,335,450

[45] Date of Patent: Aug. 9, 1994

[54] ASTRAGAL

[75] Inventor: Brad I. Procton, High Point, N.C.

[73] Assignee: Endura Products, Inc., Greensboro, N.C.

[21] Appl. No.: 91,772

[22] Filed: Jul. 14, 1993

[51] Int. Cl.[5] ..... E06B 7/16

[52] U.S. Cl. ..... 49/368; 49/366; 49/489.1

[58] Field of Search ..... 49/504, 492.1, 493.1, 49/490.1, 367, 366, 368, 460, 462, 475.1, 489.1

[56] References Cited

U.S. PATENT DOCUMENTS 3,137,900 6/1964 Carbary ..... 49/492.1 X
3,416,282 12/1968 Daugherty ..... 49/462 X
4,505,080 3/1985 Sailor ..... 52/211
4,573,287 3/1986 Hagemeyer et al. ..... 49/381
4,644,696 2/1987 Bursk ..... 49/367
5,035,085 7/1991 Mamelson et al. ..... 49/504

*Primary Examiner*—Peter M. Cuomo
*Assistant Examiner*—Jerry Redman

[57] ABSTRACT

An easy to assemble and install astragal is provided consisting of an exterior aluminum extrusion and an interior wooden portion. The exterior extrusion includes a pair of rearwardly extending center walls which form a channel for receiving the wooden interior portion. Attachments and door hardware can be conveniently installed in the wooden interior portion while the extruded exterior acts as cladding for durability.

3 Claims, 2 Drawing Sheets

ASTRAGAL

BACKGROUND OF THE INVENTION

1. Field of the Invention

The invention herein pertains to astragals which are used with dual door installations such as patio or french doors and particularly pertains to astragals having an extruded major component.

2. Description of The Prior Art and Objectives of the Invention

Exterior patio and french doors have become increasingly popular with homeowners and builders in recent years causing a greater demand for weather resistant astragals which are positioned therebetween. Such astragals are positioned for example, to the fixed door to form a side jamb to allow the swingable door to close thereagainst. Other installations use an astragal joined to the head jamb and sill of the door frame between two swingable doors. Conventional astragals were originally constructed entirely of wood and in recent years the durability and maintenance free aspects of aluminum have caused an upsurge in the demand for the more durable, weatherproof aluminum astragals. U.S. Pat No. 4,644,696 illustrates a typical extruded astragal having two major components. Other double door constructions utilize extruded aluminum and wood combinations as shown in U.S. Pat. No. 4,573,287 where the extruded components protect the wood from weather exposure.

Astragals which are formed entirely of aluminum extrusions are durable but are difficult for carpenters and the like to install since door bolts and other fittings necessary for proper door operation must be precisely aligned. Door bolt openings can be factory aligned in the astragals, however if misalignment with the door is discovered at the job site carpenters are perplexed in making the necessary adjustments since the metal extrusions must be cut or shaped with special tools which many carpenters do not have. Also, extruded components cannot be easily patched and painted as can the wood components as is often necessary during construction and assembly. Astragals formed only of wood suffer from harsh weather and must be constantly painted and maintained for proper appearance.

Thus, with the problems and disadvantages of prior art astragals, the present invention was conceived and one of its objectives is provide an astragal utilizing the desired characteristics of both wooden and extruded aluminum components.

It is yet another objective of the present invention to provide an astragal which can be easily assembled and installed at the job site without special tools or training.

It is also an objective of the present invention to provide an astragal having an aluminum extruded exterior portion and a wooden interior portion.

It is still another objective of the present invention to provide an astragal which includes a pair of rearwardly extending walls of different lengths which form a U-shaped channel for securing the interior wooden member tightly therein.

It is yet another objective of the present invention to provide an astragal which can be easily fitted with a door bolt at the job site using conventional carpenter's tools.

Various other objectives and advantages of the present invention will become apparent to those skilled in the art as a more detailed description is set forth below.

SUMMARY OF THE INVENTION

The aforesaid and other objectives are realized by providing an astragal consisting of an extruded aluminum exterior portion having a face and a series of rearwardly extending walls. A pair of parallel center walls extending from the face form a channel for receiving a wooden interior portion which can be conveniently cut and fitted with a door bolt and other hardware. The extruded aluminum portion provides weather resistant cladding for the interior portion, yet is aesthetically pleasing and can be quickly installed. The wooden interior portion has a wide exposed section and a narrower clad section which includes a pair of grooves for receiving barbed terminal ends of the rearwardly extending extruded center walls. A seal wall is also provided on the extruded portion in opposing relation to one of the center walls whereby conventional weather stripping can be inserted therebetween to insure a weathertight seal when the door is closed.

DESCRIPTION OF THE PREFERRED EMBODIMENT

Figure 3:
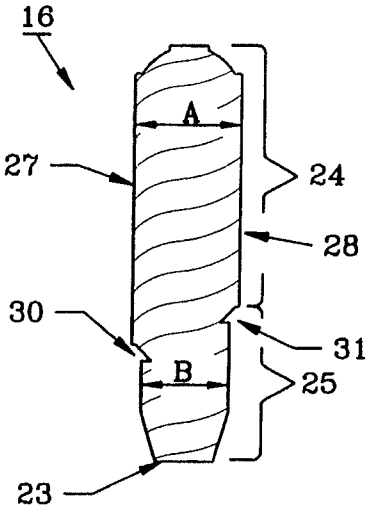
FIG. 3 shows an enlarged top view of the wooden interior portion of the astragal as shown in FIG. 2.
Figure 4:
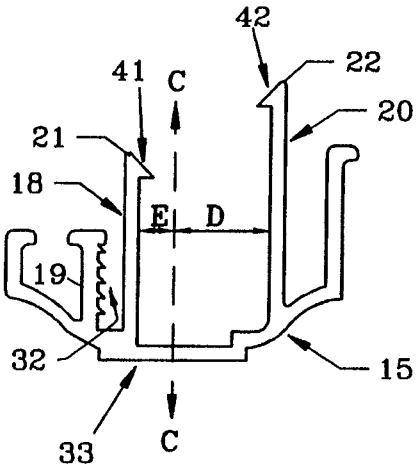
FIG. 4 shows a top view of the enlarged exterior portion of the astragal as shown in FIG. 2 removed from the interior portion.
Figure 2:
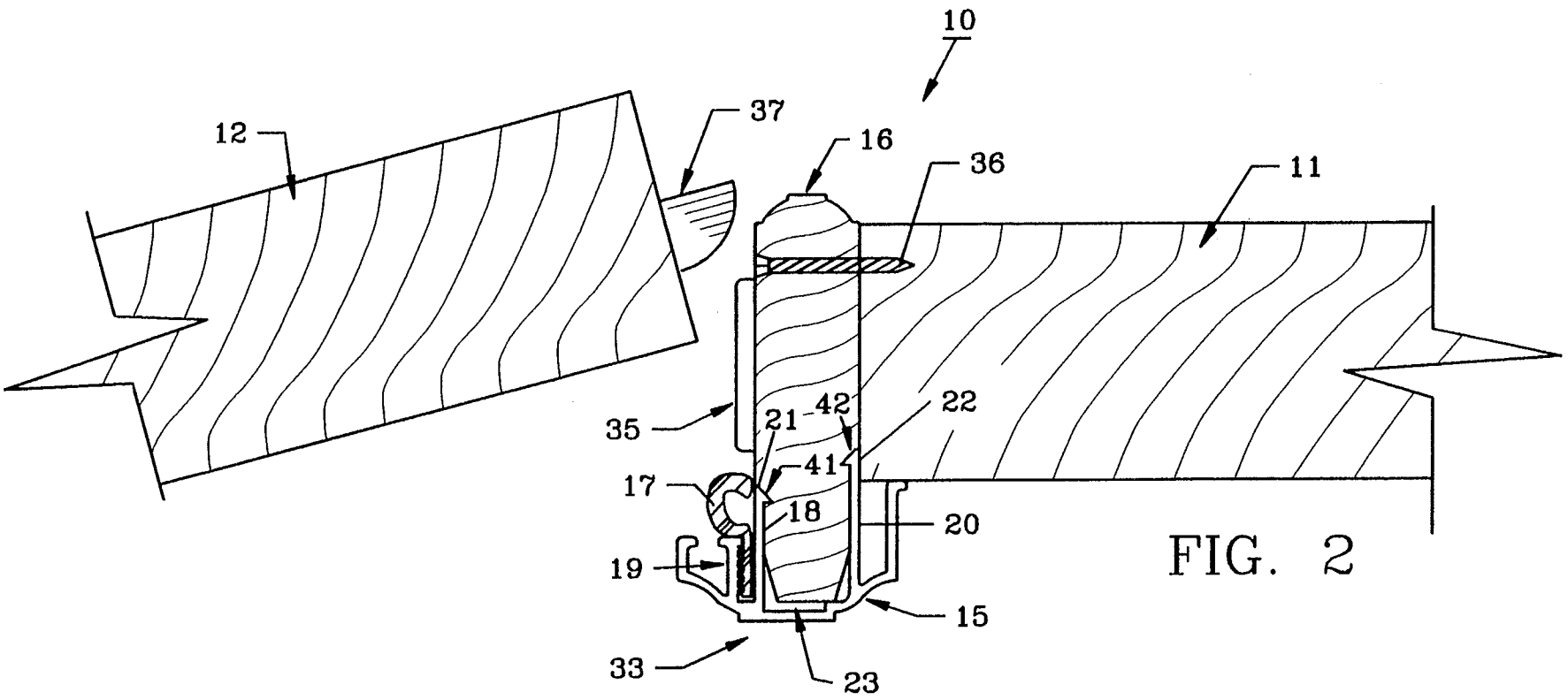
FIG. 2 shows a top sectional view of the installation as seen along lines 2—2 as shown in FIG. 1 but with the swingable door slightly open.

The preferred form of the invention is shown in FIGS. 2, 3 and 4 whereby an astragal is formed having a wooden interior portion which is joined to an extruded aluminum exterior portion. The extruded aluminum portion has baked-on enamel or a similar durable finish in a desired color. The extruded portion includes a pair of slightly offset, rearwardly extending center walls which have barbed terminal ends. A seal wall also is provided which includes a serrated surface which provides assistance in holding conventional weather stripping. The wooden interior portion has a wide exposed section and a narrower clad section. Two grooves are positioned in the wooden interior portion along the outer surface for receiving the barbed terminal ends of the center walls of the extruded exterior portion. The narrower clad section of the interior portion has a somewhat rounded end for ease during insertion between the parallel center walls of the exterior extruded portion.

DETAILED DESCRIPTION OF THE DRAWINGS AND OPERATION OF THE INVENTION

Figure 1:
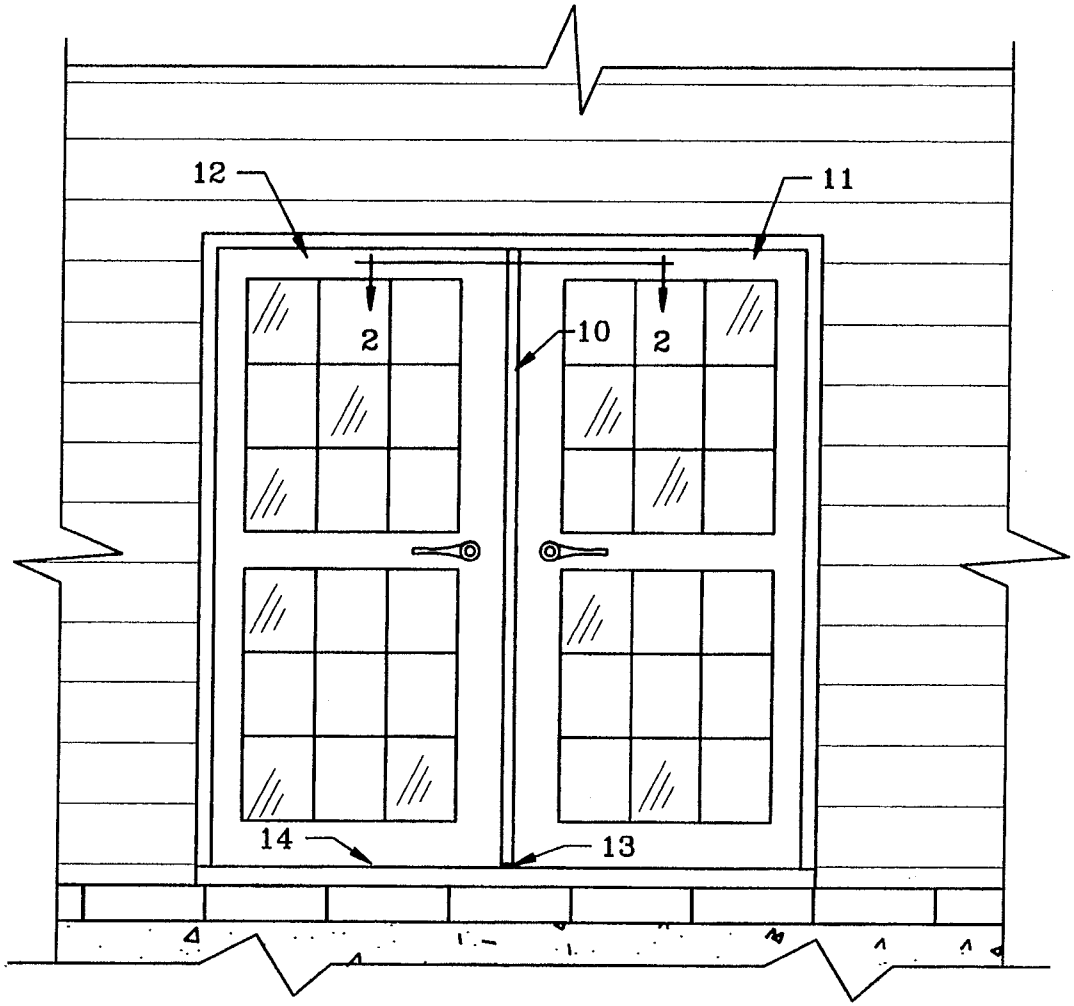
FIG. 1 illustrates a patio door installation having a fixed and a swingable door with the astragal of the invention therebetween.

For a better understanding of the invention, turning now to the drawings, FIG. 1 illustrates a typical patio door installation having astragal 10 of the invention between fixed door 11 and swingable door 12. Astragal 10 rest on a foam or other weather seal 13 on threshold sill 14. Various other doors could likewise benefit from astragal 10 such as where both doors are swingable and the illustration provided in FIG. 1 is for purposes of explanation of astragal 10 only.

FIG. 2 shows astragal 10 as seen along lines 2—2 of FIG. 1 but with door 12 slightly opened. As seen astragal 10 includes an extruded aluminum exterior portion 15 and a wooden interior portion 16. Weather stripping 17 which comprises a conventional foam weather strip is positioned in extruded exterior portion 15 between left center wall 18 and seal wall 19. Left center wall 18 and right center wall 20 have barbed terminal ends 21, 22 respectively and are different lengths with left center wall 18 extending rearwardly approximately three-fourths of an inch and right center wall 20 extending rearwardly approximately one inch.

Front end 23 of wooden interior portion 16 is somewhat rounded as shown in more detail in FIG. 3. This allows ease in insertion between left center wall 18 and right center wall 20 as illustrated in enlarged fashion in FIG. 4. Wooden interior portion 16 as seen, includes a wide exposed section 24 which has a width at A of approximately eleven-sixteenths of an inch whereas width B of narrower clad section 25 has a width of only approximately nine-sixteenths of an inch. Section 25 has a lesser width than section 24 so outer walls 27, 28 of section 24 will be flush with the outer surfaces of center walls 18, 20 as seen in FIG. 2 upon assembly. As further depicted in FIG. 3, grooves 30, 31 are provided in clad section 25 for reception of respectively, barbed terminal ends 21, 22 of center walls 18, 20 of extruded exterior portion 15 which acts as cladding as earlier explained for wooden interior portion 16. As would also be understood, exterior portion 15 may be extruded aluminum with a baked-on enamel or other finish to withstand harsh weather conditions as it is exposed to the weather as featured in FIG. 1.

In FIG. 4, center line C—C is shown drawn through exterior portion 15 with dimension line D being longer than dimensional line E. Dimension line D is longer than dimension line E as right center wall 20 is further from center line C—C than is left center wall 18. Center walls 18, 20 are offset approximately three-sixteenths of an inch to provide appropriate space for swingable door 12 to open and close. Dimension line D may be for example seven-sixteenths inches in length whereas dimension line E may be only approximately two-sixteenths inches in length. As further shown in FIG. 4, seal wall 19 extends from the front or face 33 of extruded exterior portion 15 substantially in parallel alignment with left center wall 18. Right center wall 20 also extends rearwardly from face 33 in parallel alignment with left center wall 18 but is slightly longer. Seal wall 19 has a serrated inner wall surface 32 which opposes left center wall 18 to assist in gripping weather stripping 17 as seen in FIG. 2. Barbed terminal ends 21, 22 have biased interior faces 41, 42 respectively to ease reception of clad section 25 between center walls 18, 20.

By the use of the combination wooden interior portion 16 and extruded exterior portion 15 which acts as cladding to protect portion 16, ease in working and installation is achieved. With only the use of hand tools carpenters can easily insert wooden portion 16 into exterior extruded portion 15 and can install door bolt 35 for receiving door catch 37 on the job. Wooden portion 16 can be easily secured with wood screws 36 or the like to fixed door 11 as also shown in FIG. 2. Serrated wall surface 32 of seal wall 19 opposes left center wall 18 and forms a pocket therebetween for receiving conventional weather stripping 17 therebetween.

The illustrations and examples provided herein are for explanatory purposes and are not intended to limit the scope of the appended claims.

I claim:

1. In an astragal having an extruded exterior portion which clads a wooden interior portion, the improvement comprising: a pair of substantially parallel extending center walls of unequal length, said center walls attached to said exterior portion to form a channel therebetween, said channel being offset from the center of said exterior portion , said center walls configured to receive said interior portion therebetween, each of said center wall members having a barbed terminal end, said wooden interior portion having a exposed and clad sections, said clad section for inserting between said center walls, and said clad section having a lesser width than said exposed section, said clad section having a rounded front end to expedite insertion of said clad section between said center walls, said clad section having two grooves at unequal distances from said rounded front end for receiving said barbed terminal ends, each of said barbed terminal ends having a biased interior face to expedite reception of said clad section of said wooden interior portion upon assembly of said astragal.

2. The astragal of claim 1 wherein said extruded portion is formed from aluminum.

3. The astragal of claim 1 having a seal wall extending rearwardly from said exterior portion to form a weather seal groove and having a plurality of serrations for gripping weather stripping on the surface of said seal wall that opposes said center walls.

* * * * *